US005482457A

United States Patent [19]

Aigner et al.

[11] Patent Number: 5,482,457

[45] Date of Patent: Jan. 9, 1996

[54] GAS-OPERATED PREMIXING BURNER

[75] Inventors: Manfred Aigner, Wettingen; Robin McMillan, Nussbaumen; Pirmin Schiessel, Unterehrendingen, all of Switzerland

[73] Assignee: Asea Brown Boveri Ltd., Baden, Switzerland

[21] Appl. No.: 120,086

[22] Filed: Sep. 13, 1993

[30] Foreign Application Priority Data

Oct. 16, 1992 [EP] European Pat. Off. ..... 92117673

[51] Int. Cl.[6] ..... F23C 5/00

[52] U.S. Cl. ..... 431/350; 431/351; 431/8; 431/10

[58] Field of Search ..... 431/181, 187, 431/285, 278, 350, 351, 8, 9, 10, 352

[56] References Cited

U.S. PATENT DOCUMENTS

| | | | |
|---|---|---|---|
| 3,180,395 | 4/1965 | Reed | 431/285 |
| 4,100,733 | 7/1978 | Striebel et al. . | |
| 4,408,461 | 10/1983 | Brühwiler . | |
| 4,932,861 | 6/1990 | Keller et al. | 431/354 X |
| 5,085,575 | 2/1992 | Keller et al. | 431/354 X |
| 5,193,995 | 3/1993 | Keller et al. | 431/354 X |
| 5,244,380 | 9/1993 | Dobbeling et al. | 431/354 X |

FOREIGN PATENT DOCUMENTS

| | | | |
|---|---|---|---|
| 0210462 | 2/1987 | European Pat. Off. . | |
| 0321809A1 | 6/1989 | European Pat. Off. . | |
| 0321809B1 | 6/1989 | European Pat. Off. . | |
| 0394800 | 10/1990 | European Pat. Off. | 431/10 |
| 0503319A2 | 9/1992 | European Pat. Off. . | |
| WO90/02907 | 3/1990 | WIPO . | |

*Primary Examiner*—Carl D. Price

*Attorney, Agent, or Firm*—Burns, Doane, Swecker & Mathis

[57] ABSTRACT

In a gas-operated premixing burner for the combustion chamber of a gas turbine, the fuel injected within a premixing space (21) by means of a plurality of nozzles (17) is intensively mixed with the combustion air prior to ignition. The nozzles are arranged around a burner axis (10). In order to influence the fuel profile at outlet from the burner in a specific manner, the fuel concentration in the region of the burner axis is kept greater than the average fuel concentration at the burner outlet plane (22). For this purpose, additional burner nozzles (23) are provided in the region of the burner axis (10). The additional burner nozzles (23) can be supplied via a separate fuel conduit (24).

3 Claims, 1 Drawing Sheet

GAS-OPERATED PREMIXING BURNER

BACKGROUND OF THE INVENTION

1. Field of the Invention

The invention relates to a gas-operated premixing burner for the combustion chamber of, for example, a gas turbine in which, within a premixing space, the fuel injected by means of a plurality of nozzles is intensively mixed with the combustion air prior to ignition, the nozzles being arranged around a burner axis.

2. Discussion of Background

Gas turbine combustion chambers based on premixing burners are known, for example from U.S. Pat. No. 4,408,461 to Bruhwiler et al. In such a burner, a premixing/pre-evaporation process takes place at a large excess air ratio between the injected fuel and the compressor air within a number of tubular elements before the actual combustion process takes place downstream of a flame holder. The pollutant emission figures from the combustion can be substantially reduced by this measure. Combustion with the largest possible excess air ratio— assuming that the flame still burns at all and also that not too much CO is produced—then reduces not only the $NO_x$ pollutant quantity but, in addition, also keeps the level of other pollutants low, namely the CO already mentioned and unburnt hydrocarbons. This permits the selection of a larger excess air ratio, and although larger quantities of CO are produced initially, these can react further to form $CO_2$ so that finally, the CO emissions remain small. On the other hand, however, only a small amount of additional NO is formed because of the large amount of excess air. Because a plurality of tubular elements undertake the premixing in this known combustion chamber, the number of elements operated with fuel during load control is just that number which provides the optimum excess air ratio for the particular operating phase (start, part load, full load).

Other types of premixing burners in which it is possible to dispense with the flame holder are known, in the form of double-cone burners, from for example, U.S. Pat. No. 4,932,861 to Keller et al.

All of the combustion chambers with premixing burners, however, have the shortcoming that the flame stability limit is reached, at least in the operating conditions in which only a part of the burners are operated with fuel or in which a smaller quantity of fuel is admitted to the individual burners. In fact, the flame-out limit has already been reached at an excess air ratio of approximately 2.0 under typical gas turbine conditions because of the very weak mixture and the resulting low flame temperature.

This fact leads to a relatively complicated method of operating the combustion chamber with correspondingly complex control. Supporting the burner by means of a small diffusion flame is regarded as another possibility of extending the operating range of premixing burners. This pilot flame receives pure fuel or at least badly premixed fuel. Although this leads to a stable flame, it does involve the high $NO_x$ emissions typical of diffusion combustion.

SUMMARY OF THE INVENTION

Accordingly, one object of this invention is to avoid all these disadvantages. It is based on the object of creating a measure by means of which the combustion chamber can be operated as close as possible to the weak extinguishing limit, i.e. in that region in which practically no $NO_x$ is produced.

This is achieved according to the invention, in a premixing burner of the type mentioned at the beginning, wherein in order to influence the fuel profile at the outlet of the burner in a specific manner, the fuel concentration in the region of the burner axis is greater than the average fuel concentration at the outlet plane of the burner.

For this purpose, additional fuel nozzles are expediently provided in the region of the burner axis. It is also useful for these additional fuel nozzles to be supplied via a separate fuel conduit in which is arranged a control valve which can be shut off.

The advantages of the invention may, inter alia, be seen in the support of the combustion chamber purely in critical phases, for example during the temporary occurrence of vibrations during which the conditions at times can exceed the flame-out limit for premixing combustion in the case of a uniform fuel profile. The flame generated can be kept substantially more stable by the enrichment of the fuel profile in the region of the burner axis and the resulting creation of zones with different excess air ratios.

Because the burners remain capable of operation at very weak mixtures, the control system can be simplified to the extent that during the loading and unloading of the combustion chamber, air ratio ranges can be passed through which could not, as a rule, be driven through using the previous premixing combustion (with uniform fuel profile) because of the weak-mixture flame-out limit of the latter.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a premixing burner of the double-cone type, wherein.

DESCRIPTION OF THE PREFERRED EMBODIMENTS

Figure 1:
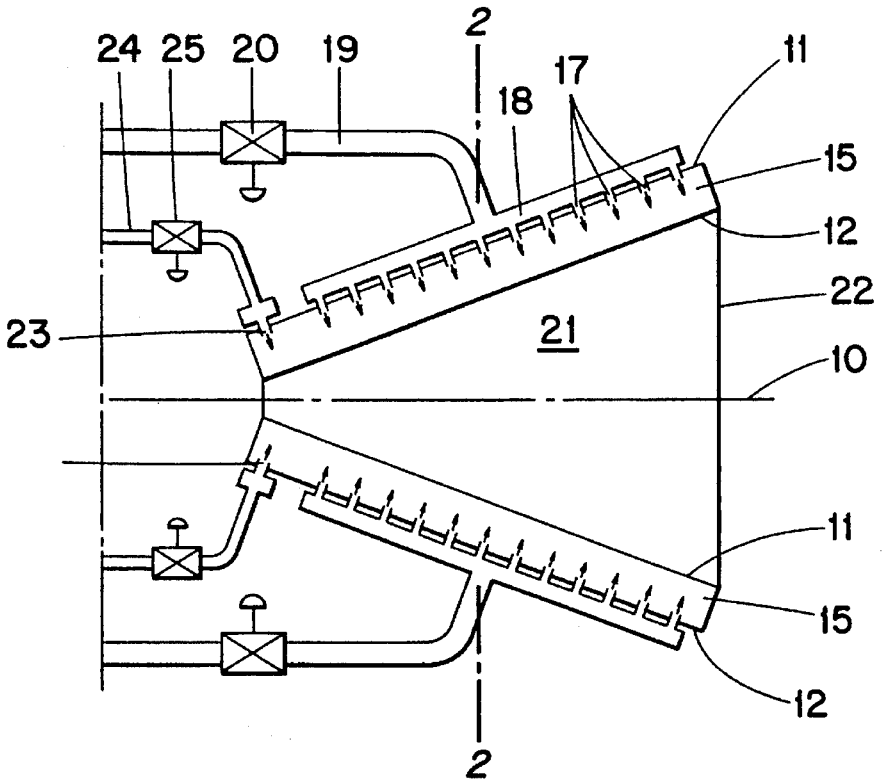
FIG. 1 shows a longitudinal section through a premixing burner.
Figure 2:
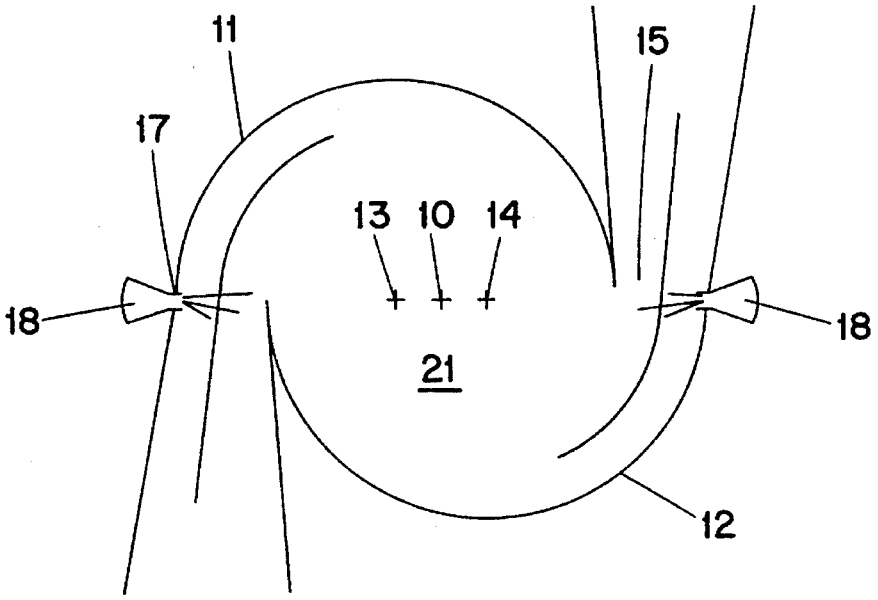
FIG. 2 shows a cross section through the premixing burner.

Referring now to the drawings, wherein like reference numerals designate identical or corresponding parts throughout the several views, wherein the flow direction of the working medium is indicated by arrows and wherein only the elements essential to understanding the invention are shown (not shown, for example, are the burner's association with and arrangement in the combustion chamber, the fuel preparation system, the control devices and the like), the diagrammatically represented premixing burner is a so-called double-cone burner such as is known, for example, from U.S. Pat. No. 4,932,861. Such burners can, for example, be arranged in the domed end of an individual combustion chamber or in an annular combustion chamber.

The burner consists essentially of two hollow, conical partial bodies 11, 12 which are interleaved in the flow direction. The respective central axes 13, 14 of the two partial bodies are mutually offset. In their longitudinal extension, the adjacent walls of the two partial bodies form tangential slots 15 for the combustion air which, in this way, reaches the premixing space 21 within the burner.

In the case shown as an example, the burner is operated with gaseous fuel. For this purpose, gas inlet openings 17 in the form of nozzles, distributed in the longitudinal direction, are provided in the region of the tangential slots in the walls of the two partial bodies. These nozzles are supplied from one collecting conduit 18 per partial cone and this collecting conduit 18 is in turn supplied from the gas supply conduit 19. The fuel control takes place by means of the control valve 20. In gas operation of this type, the formation of the mixture with the combustion air has therefore already commenced in the zone of the inlet slots 15.

A fuel concentration which is as homogeneous as possible appears at the burner outlet 22 over the annular cross section to which admission occurs. A defined cap-shaped reverse flow zone appears at the burner outlet and ignition takes place at its apex.

It is possible to operate below the $NO_x$ limiting values demanded without difficulty by means of such premixed combustion. The stability limit, however, is low because of the low flame temperature. The range between ignitability and flame-out is relatively narrow for reliable operation of the combustion chamber over the complete load range.

The invention now provides for, or detuning, the most homogeneous fuel concentration possible in a specific manner and, in fact, in such a way that there is a higher fuel concentration, which ensures a stable flame, in the region of the burner axis 10 at the outlet plane 22 of the burner.

For this purpose, additional fuel nozzles 23 are arranged in the region of the cone apex and, in consequence, at a position at which relatively little combustion air flows into the premixing space. They are supplied with gas by means of a separate fuel conduit 24. A control valve 25 is arranged in the conduit 24 for fine adjustment of the gas quantity.

The additionally injected gas quantity effects a premixed enrichment on the axis 10 of the burner. At the burner outlet, therefore, a non-uniform fuel distribution occurs over the admission cross section and, in consequence, zones occur with different excess air ratios. The largely independent core flame generated in the region of the burner axis by this means is substantially more stable than the main flame surrounding it, which is generated by means of the uniformly distributed fuel concentration. Although it is not possible to avoid somewhat more $NO_x$ being produced in this region (as a function of the excess air ratio present), the $NO_x$ occurring is still lower than that in the case of a piloted burner with a diffusion flame. The decisive feature, in any event, is the improvement to the flame-out limit without a corresponding increase in $NO_x$.

This stabilization aid—in the form of the non-uniformly distributed, but premixed, fuel distribution—can be switched off in operating ranges in which it is unnecessary, by simply shutting off the control valve 25.

The new measure, which ensures a mode of operation on the flame-out limit in the major operating range, therefore makes it possible to operate reliably with $NO_x$ figures substantially below the currently attainable figure of 20 ppm.

The invention is obviously not limited to the embodiment example represented and described. As a departure from the arrangement shown with additional nozzles, the "detuned" fuel profile in the burner outlet plane could be achieved by a non-uniform spacing of the injection nozzles 17 along the inlet slot 15 of the burner or by providing different nozzle cross sections at uniform pitch. The desired "rich" streaks, that is, the areas of higher concentration of fuel, in the mixture can be achieved with all these measures.

Fundamentally, the invention is not limited to premixing burners of the double-cone type either, in which the mixture enrichment takes place on the axis of the burner. It can be used in all combustion chamber zones in which flame stabilization is generated by a dominant air velocity field.

For purposes of mixed oil/gas operation, the double-cone burner represented could, furthermore, be additionally equipped with a fuel nozzle for liquid fuel located on the burner axis at the cone apex. By this means, the fuel can be sprayed into the hollow cone at a certain angle. The resulting conical liquid fuel profile is enclosed by the tangentially entering combustion air. In the axial direction, the concentration of the fuel is continually reduced because of the mixture with combustion air.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by Letters Patent of the United States is:

1. A gas-operated premixing burner for the combustion chamber of a gas turbine, the burner having a premixing space, comprising:

two conical sections positioned so that the premixing space is conically shaped, the burner having a cone apex positioned on a burner longitudinal axis;

means for introducing combustion air: into the premixing space;

a plurality of nozzles arranged around the burner axis and directed to introduce a first fuel quantity into the premixing space where the fuel mixes with inflowing combustion air; and means for introducing a second fuel quantity comprising additional fuel nozzles located in a region of the cone apex so that at an outlet plane of the burner perpendicular to the axis a fuel concentration in a region of the burner axis is greater than an average fuel concentration across the outlet plane.

2. The premixing burner as claimed in claim 1, further comprising a fuel conduit for supplying the second fuel quantity to the additional fuel nozzles independently of the first fuel quantity supplied to the plurality of nozzles.

3. The premixing burner as claimed as claim 2, wherein the fuel conduit is provided with a control valve for selectively controlling the second quantity of fuel flowing to the additional nozzles.

* * * * *